United States Patent [19]
Willenbring et al.
[11] 4,317,564
[45] Mar. 2, 1982

[54] FILM TRAY ASSEMBLY FOR PHOTOGRAPHIC FILM CUTTER

[75] Inventors: Armer J. Willenbring, Edina; Warren J. Osby; James W. Gausman, both of Minneapolis, all of Minn.

[73] Assignee: Pako Corporation, Minneapolis, Minn.

[21] Appl. No.: 186,187

[22] Filed: Sep. 11, 1980

Related U.S. Application Data

[62] Division of Ser. No. 25,754, Apr. 2, 1979, Pat. No. 4,280,381.

[51] Int. Cl.[3] ..... B65H 31/20
[52] U.S. Cl. ..... 271/223
[58] Field of Search ..... 271/220, 223, 224

[56] References Cited

U.S. PATENT DOCUMENTS

| | | | |
|---|---|---|---|
| 1,086,353 | 2/1914 | Dick | 271/220 |
| 3,046,010 | 7/1962 | Schneider | 271/223 |
| 3,630,517 | 12/1971 | Enskat | 271/220 |
| 3,706,373 | 12/1972 | Smith | 83/365 X |
| 4,073,223 | 2/1978 | Crawford | 83/94 X |
| 4,139,980 | 2/1979 | Larson | 83/86 X |
| 4,146,218 | 3/1979 | Loftus | 271/220 |
| 4,221,378 | 9/1980 | Kamath | 271/220 |

FOREIGN PATENT DOCUMENTS

| | | | |
|---|---|---|---|
| 709218 | 5/1954 | United Kingdom | 271/220 |
| 789015 | 1/1958 | United Kingdom . | |

OTHER PUBLICATIONS

Brochure entitled "Make Your Plant More Profitable . . . ", p. 15, entitled CX Tri-Cutter.
Advertisement in *Photo Marketing*, Mar. 1978, regarding Delta 24 Negative Cutter.
Pako Images, Jul. 1977, p. 2, re Models FC-201 and FC-101 Film Cutters.
Pako FC-300 Film Cutter Brochure.
Byers Multi-Cutter Brochure.

*Primary Examiner*—Richard A. Schacher
*Attorney, Agent, or Firm*—Kinney, Lange, Braddock, Westman and Fairbairn

[57] ABSTRACT

Cut lengths or segments of photographic strip material, particularly photographic film, are stacked as they are discharged from a photographic film cutter. The device for stacking the cut lengths includes a tray, an arm, a base, and a guide. The base is connected to the film cutter, and supports the film tray with the first end of the tray positioned closely to the discharge end of the film cutter. The arm is positioned in generally overlying position with respect to the tray and is pivotally connected to the tray at the second end of the tray furthest from the discharge end of the film cutter. The arm preferably has a "W" shaped cross section which provides two lines of contact with the cut lengths of film which are deposited between the tray and the arm. The guide provides a guiding surface parallel to the path of the cut lengths along their front edges. The guide may take a plurality of positions to accommodate films of different widths. In addition, the tray may be mounted in a plurality of different positions with respect to the base to accommodate even further variation in film widths. Removal of the cut lengths of film is from the rear rather than from the front of the film tray assembly.

11 Claims, 6 Drawing Figures

FILM TRAY ASSEMBLY FOR PHOTOGRAPHIC FILM CUTTER

This is a division of application Ser. No. 25,754, filed Apr. 2, 1979 now U.S. Pat. No. 4,280,381.

BACKGROUND OF THE INVENTION

1. Field of the Invention

The present invention relates to photographic processing equipment. In particular, the present invention relates to devices for stacking cut lengths of photographic strip material, such as photographic film.

2. Description of the Prior Art

In commercial photographic processing operations, very high rates of processing must be achieved and maintained in order to operate profitably. For that reason, many rolls of photographic film are typically spliced together for processing and printing purposes. After prints have been made from the photographic film, the individual customer's film must be separated from the large roll of film formed by the spliced-together film strips. Typically, the customer's film is cut into strips of several frames each so that the strips can be placed in flat in an envelope together with the prints.

Film tray assemblies have been developed in the past for use with photographic film cutters. These film tray assemblies receive the cut segments of photographic film and stack the segments which belong to each customer order. When all of the segments belonging to a particular customer order have been stacked, the operator removes the film from the film tray assembly and inserts the film segments into a customer order envelope.

One type of film tray assembly which has been used in the past has a lower plate or tray and an upper plate or arm. The arm is pivotally connected to the tray at the end closest to the knife of the film cutter, or along the back edge of the tray and arm. The films are deposited between the tray and the arm. The film segments are removed from the front side of the assembly.

This type of film tray assembly, however, has several disadvantages. First, the removal of the film by the operator has been somewhat awkward or inconvenient in practice. Second, many of the prior art film tray assemblies have been able to handle only a limited number of film widths. Third, some of the prior art devices have required springs which tend to break during use. Fourth, the stacking of the films by the prior devices has not been altogether satisfactory, the films are often staggered with respect to one another, and require alignment of their edges by the operator prior to insertion in the customer envelope. This, of course, reduces the efficiency of the entire process.

SUMMARY OF THE INVENTION

The present invention is a device for stacking cut lengths of photographic strip material such as photographic film. The device includes a tray upon which cut lengths of photographic strip material are stacked, an arm positioned in generally overlaying position with respect to the tray, and connecting means for connecting the arm and tray. The first ends of the tray and the arm are positioned proximate the source of the photographic strip material, and the connecting means connects the arm and tray proximate their second ends. Removal of the stacked cut lengths is from the rear rather than the front of the assembly.

In the preferred embodiments the arm has a generally "W" shaped cross section so that the arm contacts the cut lengths of photographic strip material on only two lines of contact. The connecting means connects the arm and the tray so that the arm may move away from the tray while maintaining the two lines of contact with the stacked cut lengths.

The device of the present invention preferably further includes a base which underlies and supports the tray and guide means which are connected to the tray and the base for providing a guiding surface for the front edge of the cut lengths. The positions of the tray and the guide means with respect to the base are changeable to accommodate films of different widths.

DETAILED DESCRIPTION OF THE PREFERRED EMBODIMENTS

Figure 1:
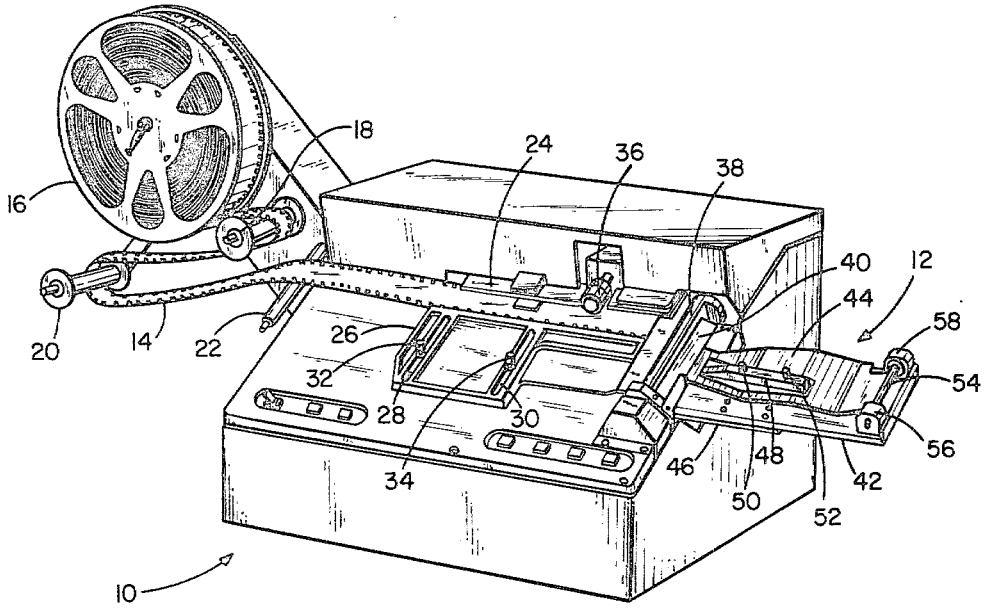
FIG. 1 is a perspective view of a photographic film cutter utilizing the film stacking tray assembly of the present invention.

In FIG. 1, photographic film cutter 10 is shown which utilizes a film stacking tray assembly 12 of the present invention. Film cutter 10 cuts individual lengths or segments of film from film strip 14, and the cut film segments are stacked in film tray assembly 12. In the embodiment shown in FIG. 1, both the top surface of film cutter 10 and film tray assembly 12 are inclined with respect to horizontal so that their front edges are lower than their rear edges.

As shown in FIG. 1, film strip 14 is fed from supply roll 16, over roller 18, bale arm 20, and arm 22 into a film track defined by rear film guide 24 and front film guide 26. Rear guide 24 is fixed, while front guide 26 is movable in direction transverse to the film path to accommodate various film widths. Front guide 26 has two slots 28 and 30 which allow movement of front guide 26. Thumb screws 32 and 34 secure front film guide 26 in the desired position. In the embodiment shown in FIG. 1, front guide 26 is adjustable to handle film sizes from 110 (i.e. ten mm) to seventy mm in sleeved or unsleeved form.

Film strip 14 is driven by a stepper motor (not shown) through a bottom drive roller 36 (not shown and a corresponding top drive roller 36. When film strip 14 has been advanced sufficiently to align a desired cut location with rotary knife 38, knife 38 is actuated thereby severing the portion of film strip 14 extending beyond knife 38 into film tray assembly 12.

Mounted immediately beyond knife 38 is guard plate 40. The purpose of guard plate 40 is to prevent an operator from placing his fingers into a position where they could be cut by knife 38.

Film tray assembly 12 receives film strip 14 as it is being driven past knife 38. When knife 38 cuts a film segment from film strip 14, the cut segment is held between tray 42 and arm 44 of tray assembly 12. Tray 42 is supported by mounting base 46. Guide 48 is connected to tray 42 and base 46 by mounting screws 50 and 52, and provides a guiding surface for the front edge of film strip 14.

Figure 2A:
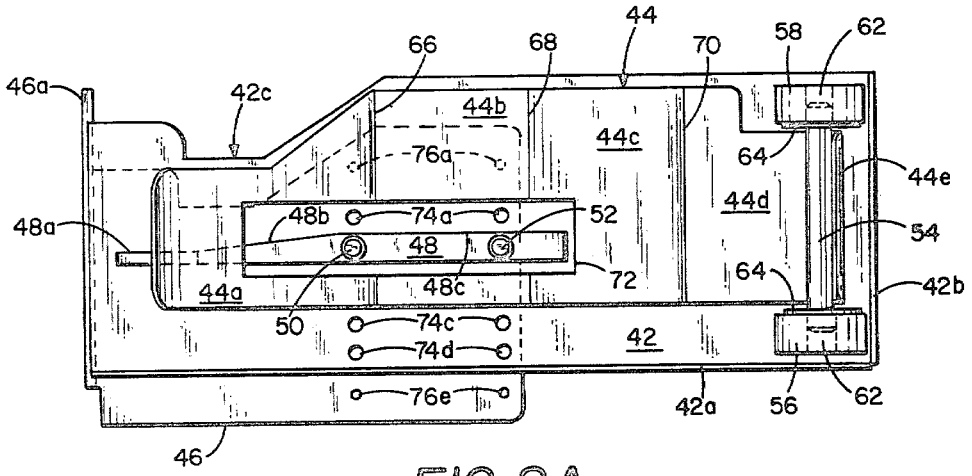
FIGS. 2A and 2B are top and side views of the film stacking tray assembly of the present invention.
Figure 2B:
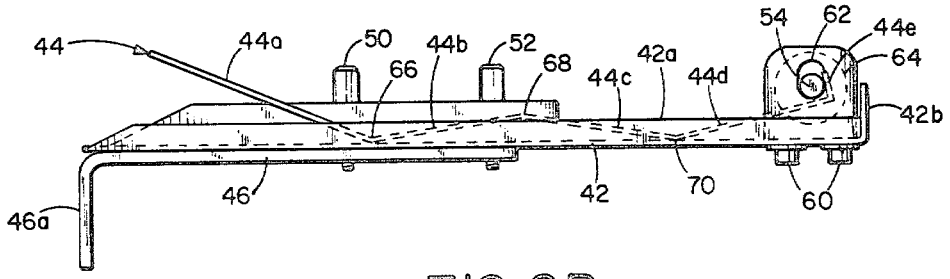
Figure 3:
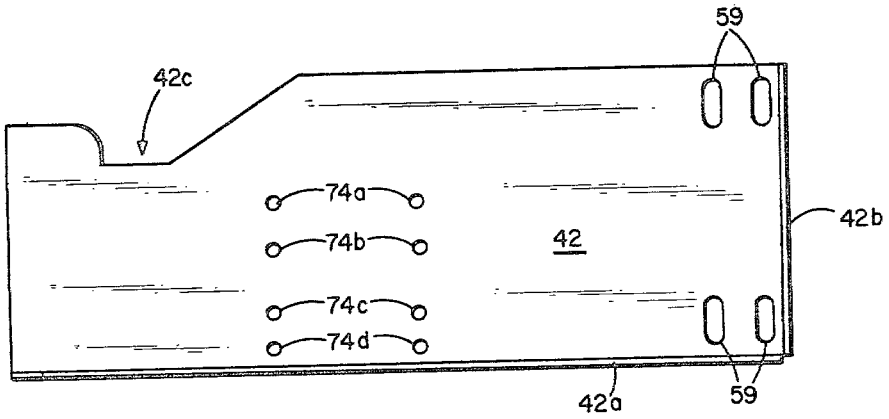
FIG. 3 is a top view of the tray element of the film stacking tray assembly of the present invention.
Figure 4B:
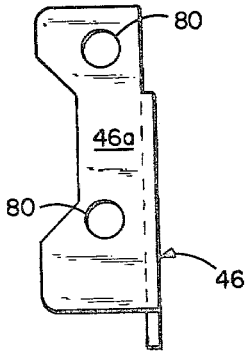
FIGS. 4A and 4B are top and end views of the base of the film stacking tray assembly of the present invention.
Figure 4A:
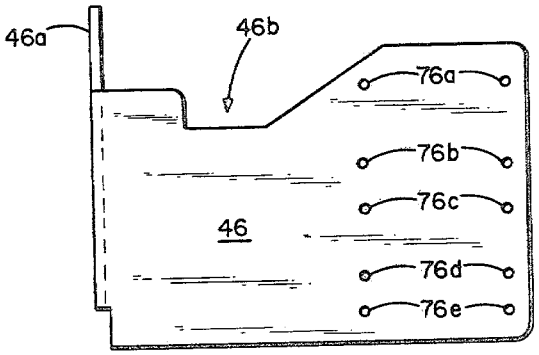

Film tray assembly 12 is shown in further detail in FIGS. 2A, 2B, 3, 4A and 4B. FIGS. 2A and 2B are top and front side views of the entire assembly; FIG. 3 is a top view of film tray 42; and FIGS. 4A and 4B are top and end views of mounting base 46.

As shown in FIG. 1 and in FIGS. 2A and 2B, arm 44 is connected to film tray 42 by pivot pin 54 and connecting blocks 56 and 58. Pivot pin 54 is preferably welded to arm 44 at the end of arm 44 which is furthest from knife 38.

Connecting blocks 56 and 58 are connected to tray 42 by screws 60 which project upward through slotted mounting holes 59 in tray 42 (best shown in FIG. 3) and into mounting blocks 56 and 58. Mounting blocks 56 and 58 are positioned at the end of tray 42 which is furthest from knife assembly 38.

Mounting blocks 56 and 58 have elongated holes 62 in which the ends of pivot pin 54 are inserted. Washers 64 are preferably positioned at each end of pivot pin 54 between arm 44 and mounting blocks 56 and 58 to ensure free movement of pivot pin 54 in all positions. Holes 59 are slotted to permit adjustment of mounting blocks 56 and 58 to eliminate excessive side play of arm 44 and pin 54.

The elongated shape of holes 62 permits pivot pin 54 and arm 44 to not only pivot about the axis of pivot pin 54, but also to move in a direction perpendicular to the plane of the top surface of film tray 42. As a result, arm 44 is permitted to move away from film tray 42 as additional cut segments of film strip 14 are deposited between arm 44 and film tray 42. Pivot pin 54 and connecting blocks 56 and 58, therefore, connect arm 44 to film tray 42 and prevent any side-to-side movement of pin 54 and arm 44 along the axis of pin 54 as well as movement in the direction of the film path. On the other hand, they permit arm 44 to pivot about the axis of pivot pin 54 and also to move toward or away from the top surface of film tray 42.

In the preferred embodiments of the present invention shown in FIGS. 1, 2A, and 2B, arm 44 has a generally "W" shaped cross section. At the end of arm 44 closest to knife 38 is first inclined portion **44*a*, which slopes downward toward the top surface of film tray 42. At the lower end of first inclined portion 44*a* is first transverse bend 66. Second inclined portion 44*b* slopes upward from first transverse bend 66, away from film tray 42. At the top end of second inclined portion 44*b* is second transverse bend 68. Third inclined portion 44*c* slopes downward from second transverse bend 68 toward film tray 42. Third transverse bend 70 is located at the end of third inclined portion 44*c*. Fourth inclined portion 44*d* slopes upward from third transverse bend 70 and tray 42. At the end of fourth inclined portion 44*d* which is furthest from knife 38, flange 44*e* is turned upward, and pivot pin 54** is attached.

The "W" shaped cross section of arm 44 causes arm 44 to contact the film segments being stacked between arm 44 and tray 42 at only two points or lines of contact; i.e. at first transverse bend 66 and third transverse bend 70. These two lines of contact are sufficient to hold the film securely between arm 44 and tray 42 while permitting additional films to be inserted on top of the stack. The two lines of contact, together with the unique connecting of arm 44 to tray 42, permits a reliable two-line contact to the film, regardless of the number of segments of film which have been stacked. It is far easier to consistently maintain two lines of contact than to maintain two planes essentially parallel to one another at all times regardless of the thickness of the stack.

In the preferred embodiments of the invention, base 46 is mounted to film cutter 10 so that the plane of the top surface of film tray 42 is positioned parallel to but below the plane of the deck of the film cutter across which the film is transported. This permits the film segments to be stacked one on top of the other between tray 42 and arm 44. First inclined portion **44*a* of arm 44 acts to deflect the leading end of film strip 14 being driven past knife 38 downward and onto either tray 42 (if no film has been stacked), or on top of the top segment of the stacked film. As the film continues to be driven toward the opposite end of tray 42, arm 44 is moved slightly upward to accommodate the additional thickness of the newly inserted film strip. When knife 38 cuts the film, the trailing end which has just been cut snaps downward so as to be out of the path of the leading end of the next film segment which is advanced past film knife 38**.

Film guide 48 defines the location of the front edge of film strip 14 as it is driven into film tray assembly 12. Arm 44 has a generally rectangular aperture 72 which permits arm 44 to be positioned over tray 42 without interfering with guide 48. As best shown in FIG. 2A, film guide 48 has a first section **48*a* which is positioned nearest the knife 38. First section 48*a* has the narrowest width and also has an inclined surface. Second section 48*b* has a tapered width which is increasing from first portion 48*a* to third portion 48*c*. The increasing width occurs along the rear edge of portion 48*b*, which engages the film. The final section 48*c* has a uniform thickness and has a rear edge which is essentially parallel to the film path. The purpose of the change in widths of guide 48 is to gradually guide the film into a uniform pile. As a result, slight variations in the lateral or transverse position of film strip 14 as it is driven past knife 38 are corrected by guide 48**.

In the present invention, removal of the film segments from tray assembly 12 is from the rear of tray assembly 12, rather than from the front of assembly 12. It has been found that this is a more efficient motion for the operator than is removal from the front side, as has been used in prior art film trays. To accommodate the easy removal of film from between tray 42 and arm 44, first inclined portion **44*a* of arm 44 is partially cut away at its front and rear sides. Similarly, both tray 42 and base 46 have cut-away portions corresponding in location to the narrower portion of arm 44. The stack of film segments are removed by the operator, therefore, by grasping the film which is exposed by the cut-away rear portions of arm 44 and tray 42**.

An important advantage of the film tray assembly 12 of the present invention is that it accommodates a wide range of film sizes. In the preferred embodiments shown in the Figures, film tray assembly 12 accepts and stacks films ranging from 110 size (i.e. ten mm) up to seventy mm width film.

To permit operation with a wide variety of different film sizes, film tray 42 is provided with four sets of parallel mounting holes **74*a*, 74*b*, 74*c*, and 74*d*, as shown in FIG. 3. Similarly, base 46** as shown in FIG. 4*a* has five sets of parallel holes **76*a*, 76*b*, 76*c*, 76*d* and 76*e*. Any one of the four sets 74*a*–74*d* of holes in tray 42 may be aligned with any one of the five sets of holes 76*a*–76*e* of base 46. Tray 42 is mounted to base 46 by guide 48 and mounting screws 50 and 52. In the preferred embodiments, holes 76*a*–76*e* in base 46** are threaded so that tightening of screws 50 and 52 clamps guide 48, tray 42, and base 46 together.

It can be seen, therefore, that a wide variety of different positions of tray 42, base 46, and guide 48 are possible. In practice, tray 42 typically takes only two of the possible positions with respect to base 46. For 110 size film, holes 74*a* of tray 42 are aligned with holes 76*a* of base 46, and guide 48 is positioned so that screws 50 and 52 are threaded through holes 74*a* into holes 76*a*. For all other film sizes up to seventy millimeter, holes 74*a*–74*d* are aligned with holes 76*b*–76*e*, respectively. In this position, guide 48 may take one of four different positions. Other intermediate alignments of tray 42 and base 46, of course, may also be used, such as is illustrated in FIG. 2.

In some alignments, guide 48 is located outside of aperture 72 of arm 44. In these cases, however, guide 48 is located between the front edge of arm 44 and front flange 42*a* of tray 42, so that guide 48 does not interfere with arm 44. The width of aperture 72 in arm 44 has been selected with respect to the locations of holes 74*a*–74*d* so that in all cases in which guide 48 must underly arm 44, aperture 72 overlies guide 48.

The position of guide 48 is selected so that a portion of the film be exposed by the cut-away portion of first inclined portion 44*a* of arm 44. In other words, guide 48 is positioned so that a portion of the film is exposed so that the operator can grasp and remove the stack of cut film segments.

As shown in FIG. 3, tray 42 preferably is a metal plate with front flange 42*a*, end flange 42*b*, and cut-away portion 42*c*. The location and shape of cut-away portion 42*c* corresponds generally to the cut-away portion of arm 44.

FIGS. 4A and 4B show base 46, which is a metal plate of sufficient strength to support the remainder of assembly 12. Base 46 has a mounting flange 46*a*, which connects base 46 to film cutter 10 in a position immediately below knife 38. Mounting holes 80 in mounting flange 46*a* permit connection of flange 46*a* by means of screws (not shown). As described previously, base 46 also has a cut-away portion 46*b* which corresponds generally in shape and location to cut-away portion 42*c* of tray 42.

The film stacking tray assembly of the present invention has several important advantages over the prior art film tray assemblies. First, it permits the operator to remove the cut film segments from the rear rather than the front side. As stated previously, this has proved to be a more efficient motion by the operator, who then inserts the cut film segments into a customer envelope.

Second, the film tray assembly handles a wide range of film sizes. The conversion from one film width to another is fast and simple, and requires only loosening screws 50 and 52 and shifting the position of guide 48, base 46 and tray 42 with respect to one another.

Third, because arm 44 is pivoted at the end furthest from knife 38, it provides greater accessibility to the knife area in comparison to the prior art film trays, where the pivot is located at the end closest to the knife. This is an advantage in cases of a misfeed due to the film jamming, or some other service problem.

Fourth, film tray assembly operates using the force of gravity on arm 44 to hold the film strips between arm 44 and tray 42. No springs are required. This significantly reduces the likelihood of service problems.

Fifth, the film tray assembly of the present invention provides more uniform and reliable stacking of cut film segments than the prior art assemblies. This is an important advantage because it reduces the amount of rearranging and restacking of the film segments which must be performed by the operator prior to inserting the film segments into a customer order envelope.

Sixth, the film tray assembly of the present invention is extremely simple, with a small number of easily manufactured parts.

Although the present invention has been described with reference to preferred embodiments, workers skilled in the art will recognize that changes may be made in form and detail without departing from the spirit and scope of the invention.

What is claimed is:

1. A device for stacking cut segments of photographic strip material, the device comprising:

a tray having first and second ends and a first surface upon which the segments are stacked, the first end being positioned proximate a source of the segments;

an arm positioned in generally overlying position with respect to the tray to receive and hold the segments between the arm and the tray, the arm having first and second ends and first, second, third, and fourth inclined surfaces, the first inclined surface sloping from the first end to a first transverse line which is closer to the first surface of the tray than the first end, the second inclined surface sloping away from the first transverse line and the first surface of the tray to a second transverse line, the third inclined surface sloping from the second transverse line toward the first surface of the tray to a third transverse line, and the fourth inclined surface sloping away from the third transverse line and the first surface of the tray to the second end of the arm, whereby the first and third transverse lines form lines of contact between the arm and the cut lengths of photographic strip material; and connecting means for connecting the arm and tray proximate their second ends, the connecting means permitting movement of the arm away from the tray while maintaining the first and third transverse lines in contact with the top segment of the stacked segments as additional segments are deposited between the arm and the tray.

2. The device of claim 1 wherein the connecting means limits movement of the arm in directions transverse and parallel to a path of the segments as they are deposited between the arm and the tray.

3. The device of claim 2 wherein the connecting means comprises:

a pivot pin attached to the arm proximate its second end; and first and second pivot blocks connected to the tray proximate the second end of the tray, the pivot blocks having elongated slots generally perpendicular to the first surface of the tray for receiving opposite ends of the pivot pin, and wherein the pivot pin is movable in the elongated slots.

4. The device of claim 1 and further comprising:

guide means connected to the tray for providing a guiding surface for one edge of the segments as they are deposited between the arm and the tray.

5. The device of claim 4 wherein the guide means provides a guiding surface for front edges of the segments.

6. The device of claim 4 wherein the arm has an aperture which permits the arm to overlay the guide means without interference between the arm and the guide means.

7. The device of claim 1 and further comprising:

a base underlying the tray; and means for connecting the tray to the base.

8. The device of claim 7 wherein the tray is positionable in a plurality of positions with respect to the base to permit segments of different widths to be stacked.

9. The device of claim 8 wherein the base has a plurality of mounting holes and wherein the tray has a plurality of matching mounting holes which permit the tray to be positioned in a plurality of different positions with respect to the base.

10. The invention of claim 9 and further comprising:

guide means connected to the tray and the base for providing a guiding surface for one edge of the segments.

11. The device of claim 10 wherein the guide means has mounting holes and wherein the means for connecting the tray to the base comprise mounting screws extending through the mounting holes in the guide means and the mounting holes in the tray and into the mounting holes in the base.

* * * * *